United States Patent [19]

Cloud et al.

[11] 4,046,328

[45] Sept. 6, 1977

[54] APPARATUS TO ASSIST DOFFING PACKAGES IN A YARN WINDUP

[75] Inventors: Nathan Cloud, Wilmington, Del.; James Edwin Smith, Waynesboro, Va.

[73] Assignee: E. I. Du Pont de Nemours and Company, Wilmington, Del.

[21] Appl. No.: 684,932

[22] Filed: May 10, 1976

[51] Int. Cl.[2] ..... B65H 67/04

[52] U.S. Cl. ..... 242/18 A

[58] Field of Search ..... 242/18 A, 18 DD, 18 R, 242/25 A

[56] References Cited

U.S. PATENT DOCUMENTS

| | | | |
|---|---|---|---|
| 3,521,826 | 7/1970 | Schmick | 242/18 A |
| T901,005 | 8/1972 | Shelley et al. | 242/18 A |

*Primary Examiner*—Stanley N. Gilreath

[57] ABSTRACT

In a yarn winding apparatus that includes a pair of windup chucks alternately movable into engagement with a drive roll for winding yarn on package supports carried by the chuck, the improvement comprises a device to provide a preselected constant force between the yarn package being formed and the drive roll and to release the force while a full package is being doffed and new package is started.

1 Claim, 4 Drawing Figures

APPARATUS TO ASSIST DOFFING PCKAGES IN A YARN WINDUP

BACKGROUND OF THE INVENTION

This invention relates to continuous yarn winding equipment and particularly to auxiliary apparatus to apply a substantially constant force between a winding package and a drive roll during the formation of the package and to release this force during doffing. By doffing is meant the several steps of bringing an empty yarn package support into engagement with the windup drive roll, moving the full package of yarn away from the drive roll and transferring the yarn from winding on the full to the empty package support and removing the full package.

Satisfactory high speed yarn winding has been achieved by various winding machines such as those described by De Priest in U.S. Pat. No. 3,165,274, by Smiley in U.S. Pat. No. 3,342,428 and by Campbell et al. in U.S. Pat, No. 3,409,238. However, to provide for overend delivery of yarn from packages wound of spandex yarn, it has been found desirable to employ a large contact force between the package and the drive roll during package formation and to maintain this force constant from initial yarn laydown on a package support up until a full yarn package has been produced. Since the doffing cycle is carried out by manual manipulation of the full and empty yarn package chucks, it is desirable to eliminate this force between the package and drive roll while doffing to reduce operator fatigue and assist his successful completion of the exacting no-waste yarn transfer procedure. It has also been found important in some cases to provide fine adjustment of the magnitude for this constant force before starting a new package.

Various adjustable (but nonconstant) counterweight arrangements have been employed in the past to provide force between package and drive roll. However, these arrangements have not been readily modified to provide a substantially constant, preselected force during the full winding cycle and a releasable force during doffing.

SUMMARY OF THE INVENTION

In a yarn winding apparatus that includes a frame, a pair of windup chucks cantilevered from opposite ends of an arm attached to a plate rotatably supported from the frame by a shaft, a drive roll positioned to contact a yarn support on one of the chucks in a winding position while the other chuck is in a doffing position, said arm being attached to said plate in a fixed relationship during winding and being pivotally attached to said plate for relative rotary movement therewith during doffing, the improvement comprising means for providing a preselected constant force to said one chuck during a full winding cycle and for releasing said force while said one chuck is being doffed and said other chuck begins a winding cyle.

DESCRIPTION OF THE PREFERRED EMBODIMENT

The apparatus of this present invention is illustrated in connection with a yarn winding machine of the type disclosed in the above referenced U.S. patents and shown schematically in FIG. 1. Wherever possible, the same identifying numbers are used for like components as appear in the references.

Figures 1, 1A:
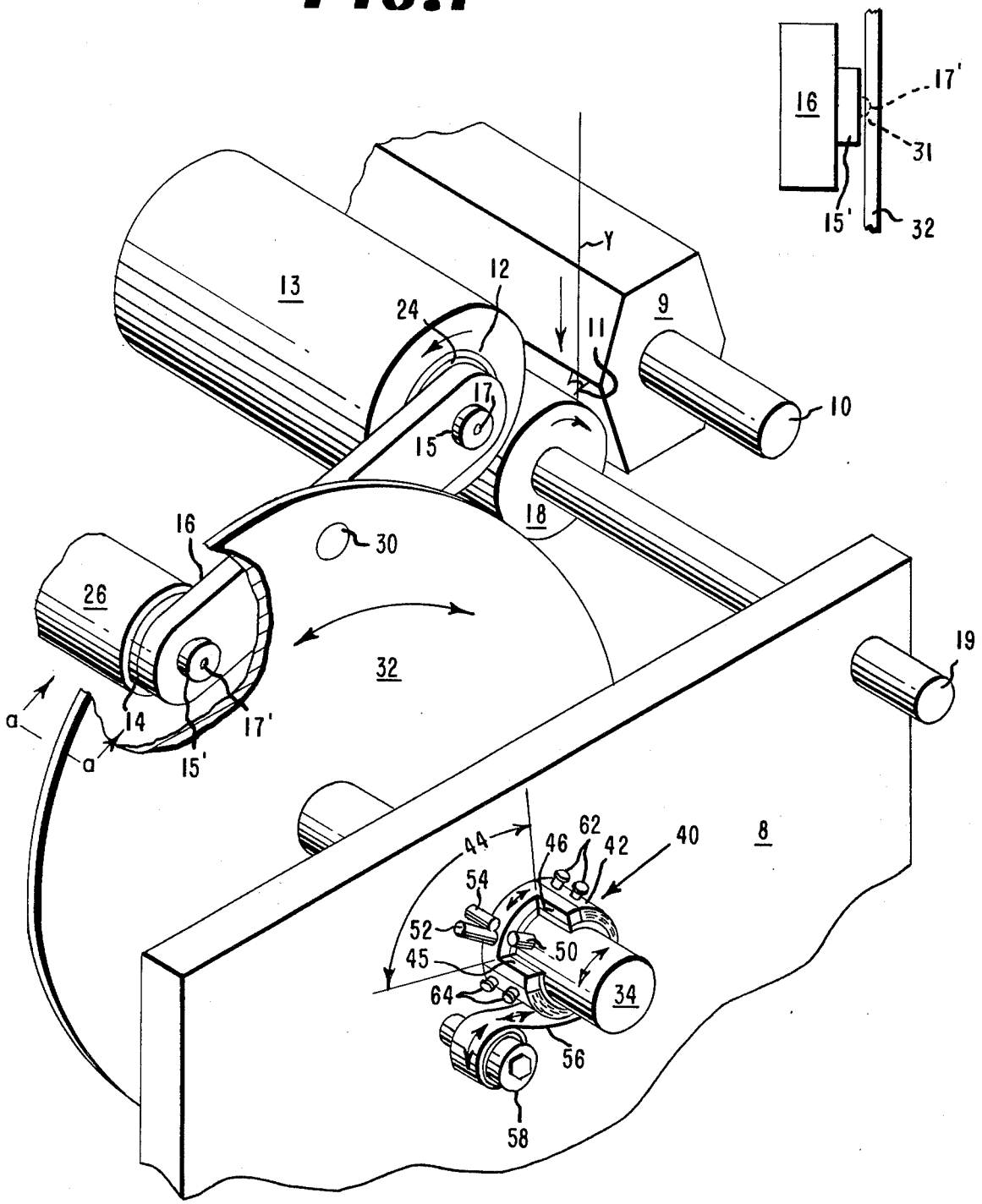
FIG. 1 is a perspective view of the apparatus with parts cut away and some dimensions distorted for ease of describing the present invention.
FIG. 1*a* is a partial end view of the plate and pivot arm of FIG. 1 taken along *a—a;*

Turning now to FIGS. 1 and 1*a*, the yarn winding apparatus is seen to include as component parts a yarn traverse housing 9 containing a traversing mechanism (not shown), driven through traverse shaft 10, which oscillates traverse guide 11 in such a way as to distribute a continuously supplied yarn Y to a drive roll 18 and thence to a package 13. Two windup chucks 12, 14 are cantilevered from opposite ends of pivot arm 16 and arranged to receive removable package supports or bobbins 24, 26, respectively. In the illustration, a yarn package 13 is shown being wound on package support 24 carried by chuck 12.

Shafts 15, 15' are provided for rotational support of chucks 12, 14, respectively. These two shafts extend forward from arm 16 and are provided spring loaded detents 17, 17' adapted to engage a recess 31 in the face of a flat cylindrical swing plate 32 to provide a releaseable locking arrangement between arm 16 and plate 32 during the actual winding of a package. Arm 16 is journaled eccentrically to plate 32 by means of shaft 30. Drive roll 18 is driven through shaft 19 by a motor (not shown). Plate 32 is supported from frame 8 by means of shaft 34 through an anti-friction bearing such that plate 32 is angularly deflectable about a horizontal axis.

The improvement comprising the present invention includes a tensioning and clutch device 40 mounted on shaft 34 on the opposite side of frame 8 from plate 32. This device comprises a cylindrical collar 42 having a sintered bronze busing 48 (FIGS. 2,3) press-fitted inside and dimensioned to fit over shaft 34 to be deflectable therearound. Collar 42 has a portion of its periphery cut out to provide an open section 44 over part of its circumference ending in radial faces 45 and 46. This cutout 44 extends through an angularly equal portion of bushing 48. A dowel pin 50 is set into shaft 34 and extends out radially therefrom. Pin 50 is so positioned to engage face 45 at the start of winding a package. Thereafter the counterclockwise (as viewed in FIG. 1) rotational motion of shaft 34 brought about by yarn package diameter growth is restrained by a constant countertorque from spring 56. During doffing the engagement of pin 50 with face 46 restricts the clockwise motion of shaft 34 and consequently the motion of plate 32. A second dowel pin 52 is set radially into the uncut portion of collar 42 and a third dowel pin 54 in mounted horizontally to frame 8 and positioned so that pin 52 may engage pin 54 to restrict the clockwise motion of collar 42.

A shoulder bolt 58 is attached to frame 8 a small distance from shaft 34 to anchor the free motion end of a constant force extension spring such as a Neg'ator® (manufactured by Hunter Spring Divison of Ametek Inc.). The other end of spring 56 is fastened to collar 42 by means of fasteners 62. This arrangement provides a constant clockwise torque to collar 42.

Figure 2:
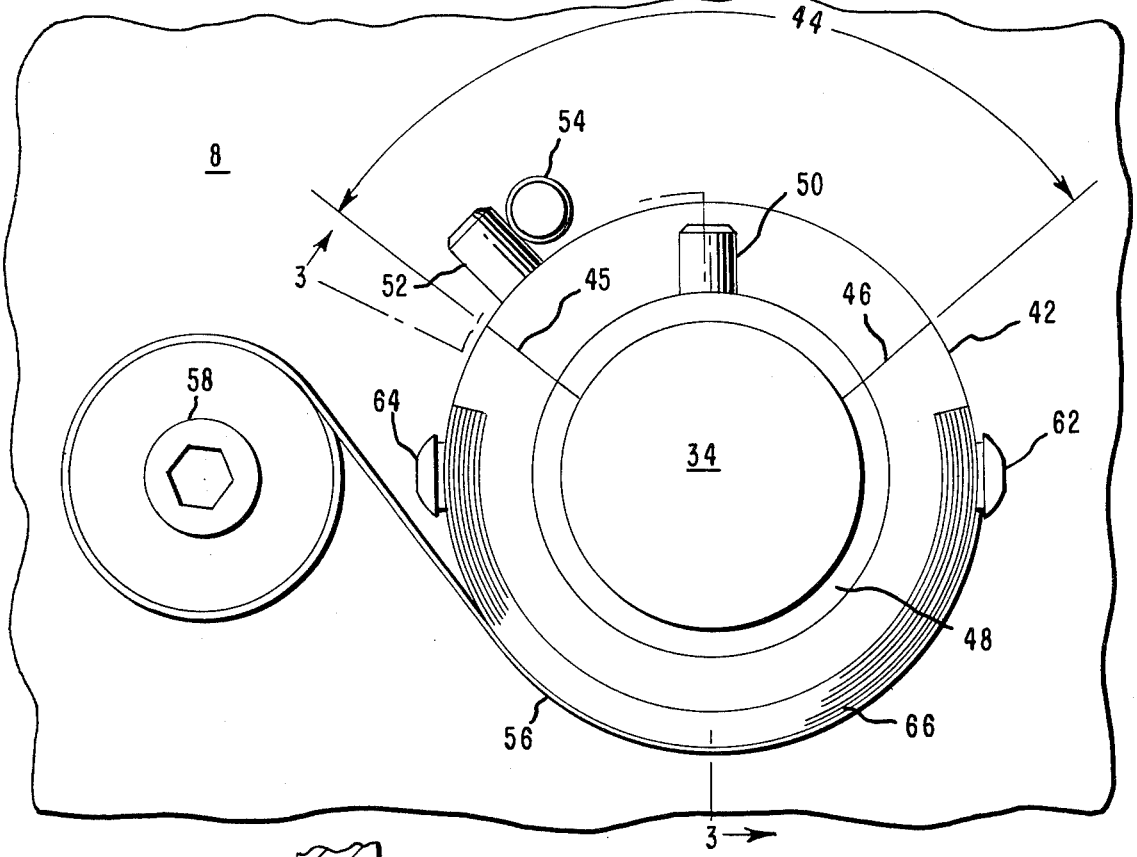
FIG. 2 is an end view of the spring, collar, and clutch arrangement in association with the support shaft for the angularly deflectable swing plate of the windup.
Figure 3:
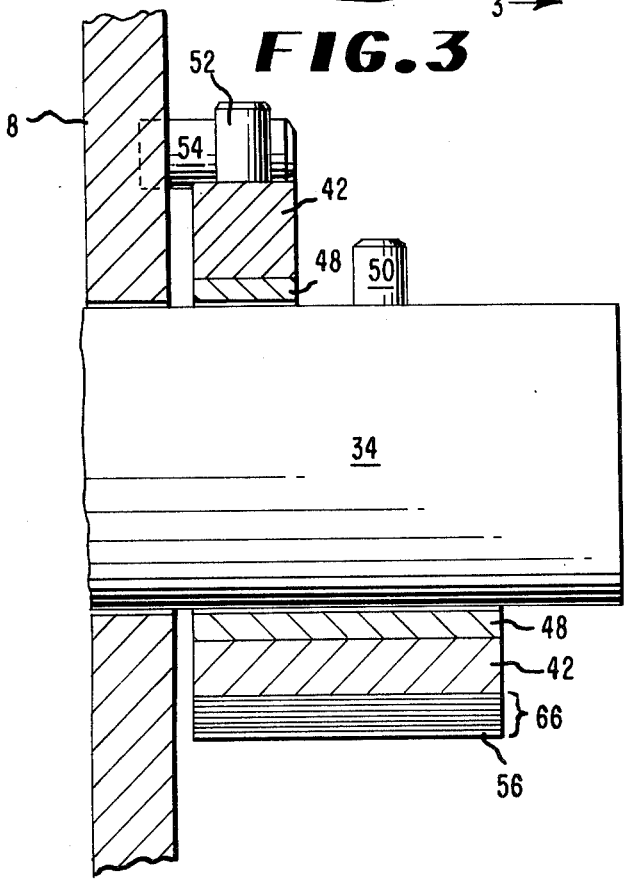
FIG. 3 is a sectional side view taken in the direction of arrows 3—3 of FIG. 2.

As shown in more detail by FIGS. 2 and 3, spring 56 extends around the bottom portion of collar 42 and is adjustably separated therefrom by means of a ¼-inch (6.4 mm) thick spacer made up of laminates of .003 inch (0.076 mm) thick shim stock 66. These laminates are fastened to collar 42 at one end by fasteners 62 (which also hold the one end of spring 56) and at the other end by fasteners 64. In the preferred embodiment these laminates are set into a peripheral groove machined into collar 42. By peeling off one laminate at a time the radius of collar 42 under spring 56 may be reduced in increments of 0.003 inch thus varying the moment arm of the spring force to the collar 42 and thence to the chuck shaft 34 and permitting "fine tuning" of chuck force to precise measurements. Of course, spring force can be varied in large increments by simply increasing or decreasing spring material thickness. This arrangement allows for an infinite number of constant chuck force settings.

In operation, during the formation of a yarn package, such as package 13 on package support 24 carried by chuck 12, the detent 17' of chuck 14 is engaged in a recess 31 (FIG. 1*a*) in plate 32 so that, as the package increases in diameter, the now rigid assembly of plate 32 and arm 16 travels counterclockwise with shaft 34. During this period collar 42 is forced by spring 56 in a clockwise direction while shaft 34 is being rotated in the counterclockwise direction by virtue of package growth. Pin 50 extending out from shaft 34 engages face 45 and in this way the rotation of shaft 34 is restrained by collar 42 with a substantially constant clockwise torque provided by spring 56. This provides a constant force between package 13 and drive roll 18 throughout the winding of the package, thus assuring an evenly would package from start to finish.

During the doffing cycle, however, the detent 17' is manually disengaged from the recess 31 in plate 32 this freeing plate 32 for rotation in a clockwise direction and permitting relative rotary movement between the plate 32 and arm 16 for manipulation of chuck 14 until suport 26 is in engagement with drive roll 18 while the package 13 continues to wind. Then chuck 14 is manually brought up to engage drive roll 18 and support 26 receives the yarn transferred from winding on package 13. After this transfer, chuck 12 is further swung counterclockwise relative to plate 32 until detent 17 now engages the recess 31 in plate 32 fixing the relationship between the plate 32 and the arm 16 and the controlled torque from spring 56 is again applied during the winding interval.

During early doffing steps, e.g., just after the release of detent 17 (or 17'), clockwise rotation of the collar 42 is restricted by the engagement of pin 52 with fixed pin 54. Shaft 34 also is now free to rotate clockwise until pin 50 contacts face 46 to provide limited free rotary movement of the shaft with respect to the collar. The precise locations of these three pins and the length of cut-out 44 must, of course, be carefully selected to provide the proper restraints during package formation and declutching during the doffing interval.

Thus, a simple inexpensive and reliable attachment has been disclosed, for a yarn winding machine of the type noted, in order to provide a preselected constant force between a yarn package being formed and the associated drive roll in such a manner that this force is released during the interval while the full package is being withdrawn and a new package started on a second package support. This has resulted in the dual advantage of an improved package structure and reduced operator fatigue during doffing along with decreased fumbling during the transfer of yarn from winding on a full to an empty package.

What is claimed is:

1. In a yarn winding apparatus that includes a frame, a pair of windup chucks cantilevered from opposite ends of an arm attached to a plate rotatably supported from the frame by a shaft, a drive roll positioned to contact yarn on one package support on one of the chucks in a winding position while the other chuck carrying another support is in a doffing position, said arm being attached to said plate in a fixed relationship during winding and being pivotally attached to said plate for relative rotary movement thereto during doffing, the improvement comprising: a collar rotatable on said shaft, said collar having a portion of its periphery cut out to provide an open section over part of its circumference, said open section being defined by two radial faces, a pin extending radially outward from said shaft into said open section; a constant force extension spring connected at one end to the periphery of said collar and at its other end to said frame, said spring leading partially around the periphery of said collar to said frame for applying a constant torque in one direction to said collar whereby said pin engages one of said two radial faces and means located near said one of said two radial faces to limit rotation of said collar with respect to said frame in said one direction whereby said shaft is free from the influence of said spring to rotate in said one direction until said pin contacts the other of said two radial faces.

* * * * *